US005589317A

United States Patent [19]

Defieuw et al.

[11] Patent Number: 5,589,317

[45] **Date of Patent: *Dec. 31, 1996**

[54] THERMAL TRANSFER IMAGING PROCESS

[75] Inventors: Geert Defieuw, Kessel-Lo; Wilhelmus Janssens, Aarschot; Herman Uytterhoeven, Bonheiden; Bart Horsten, Rumst; Jean-Marie Dewanckele, Drongen; Jan Van den Bogaert, Schilde, all of Belgium

[73] Assignee: Agfa-Gevaert N.V., Mortsel, Belgium

[ * ] Notice: The term of this patent shall not extend beyond the expiration date of Pat. No. 5,547,809.

[21] Appl. No.: 400,337

[22] Filed: Mar. 8, 1995

[30] Foreign Application Priority Data

Mar. 10, 1994 [EP] European Pat. Off. ..... 94200612

[51] Int. Cl.[6] ..... G03C 8/40; G03C 8/44

[52] U.S. Cl. ..... 430/203; 430/202; 430/350; 430/617; 430/965

[58] Field of Search ..... 430/3, 22, 617, 430/200, 202, 965, 348, 350, 356, 203

[56] References Cited

U.S. PATENT DOCUMENTS

| | | | |
|---|---|---|---|
| 2,910,377 | 10/1959 | Owen | 117/36 |
| 3,218,166 | 11/1965 | Reitter . | |
| 3,767,414 | 10/1973 | Huffman et al. | 96/114 |
| 3,795,532 | 3/1974 | Newman et al. | 117/36 |
| 5,206,112 | 4/1993 | Cotner et al. | 430/203 |
| 5,374,514 | 12/1994 | Kirk et al. | 430/619 |
| 5,380,607 | 1/1995 | Van Haute et al. | 430/3 |
| 5,384,238 | 1/1995 | Ellis et al. | 430/617 |

FOREIGN PATENT DOCUMENTS

| | | | |
|---|---|---|---|
| 246832 | 9/1962 | Australia | 430/346 |

*Primary Examiner*—Thorl Chea

*Attorney, Agent, or Firm*—Brumbaugh, Graves, Donohue & Raymond

[57] ABSTRACT

The present invention provides a method for reproducing continuous tone images by means of a thermal head. The method involves the image-wise heat transfer of a reducing agent from a donor element to a receiving layer of a receiving element. The receiving element contains a thermoreducible silver source such as e.g. silver behenate. The process of the present invention provides high density images with multiple intermediate density levels.

9 Claims, No Drawings

THERMAL TRANSFER IMAGING PROCESS

DESCRIPTION

1. Field of the Invention

The present invention relates to a thermal imaging process, more particularly to a method wherein a thermotransferable reducing agent from a donor element is transferred image-wise to a receiving layer, by means of a thermal head.

2. Background of the Invention

Thermal imaging or thermography is a recording process wherein images are generated by the use of imagewise modulated thermal energy.

In thermography two approaches are known:

1. Direct thermal formation of a visible image pattern by imagewise heating of a recording material containing matter that by chemical or physical process changes colour or optical density.
2. Formation of a visible image pattern by transfer of a coloured species from an imagewise heated donor element onto a receptor element.

A survey of "direct thermal" imaging methods is given in the book "Imaging Systems" by Kurt I. Jacobson-Ralph E. Jacobson. The Focal Press—London and New York (1976), Chapter VII under the heading "7.1 Thermography". Thermography is concerned with materials which are not photosensitive, but are heat sensitive. Imagewise applied heat is sufficient to bring about a visible change in a thermosensitive imaging material.

According to a direct thermal embodiment operating by physical change, a recording material is used which contains a coloured support or support coated with a coloured layer which itself is overcoated with an opaque white light reflecting layer that can fuse to a clear, transparent state whereby the coloured support is no longer masked. Physical thermographic systems operating with such kind of recording material are described on pages 136 and 137 of the above mentioned book of Kurt I. Jacobson et al.

Yet most of the "direct" thermographic recording materials are of the chemical type. On heating to a certain conversion temperature, an irreversible chemical reaction takes place and a coloured image is produced.

One large group of chemical thermographic systems operates with thermosensitive recording materials wherein two colour forming reactants are present, one of which fuses in the range of 60°–120° C. and reaches thereby the other reactant. According to another embodiment one of the colour-forming reactants is present in a meltable microcapsule shell or kept separate from the other reactant by a meltable barrier layer that on fusing no longer prevents the direct contact of the colour forming reaction partners.

A wide variety of chemical systems has been suggested some examples of which have been given on pages 138 and 139 of the above mentioned book of Kurt I. Jacobson et al. and by A. S. Diamond, "Specialty papers for thermal imaging", Proceedings of White Papers & Office Automation Conference, MA, 1989.

As colour-forming reactants, a combination of a leucobase and an acid is often used in a direct thermal imaging material. However, the light stability of said leuco dyes is poor and the optical densities obtained with the leucobase system in transmission are low (mostly below 2.0).

It has been suggested to use a thermoreducable silver source in combination with a reducing agent in a direct thermal film in order to increase the optical density in transmission of a printed image (see EP-A-537.975). Although continuous tones can be obtained by said printing method, the gradation produced by said printing method is too high resulting in only a few intermediate density levels. Fluctuations in the heat transfer from the heat source to the printing material result in a density difference of the final image. Thus, it is extremely difficult to obtain images having a uniform density profile. A direct thermal printing method moreover has the disadvantage that in the non-image places the co-reactants always remains unchanged, impairing the shelf-life and preservability.

Thermal dye transfer printing is a recording method wherein a dye-donor element is used that is provided with a dye layer wherefrom dyed portions or incorporated dye is transferred onto a contacting receiving element by the application of heat in a pattern normally controlled by electronic information signals.

In thermal wax printing, the dye layer is transferred to the receiving element, whereas in thermal sublimation printing, also called dye diffusion thermal transfer (D2T2) only the dye is transferred to the receiving element. Thermal wax printing has problems to generate images with continuous tones, while the thermal sublimation printing technique offers only moderate densities in transmission on film (up to 2.5). It has been suggested to increase the density of a print made by thermal sublimation printing by printing several times on the same receiving sheet.

This procedure is slow and optical densities in transmission above 3.0 are hardly obtained with a good image stability.

The above findings illustrate that extreme high densities, which are needed on film for medical purposes, controlling and lowering the gradation to the specific needs requested for special medical diagnostic applications is very difficult to realise in a reproducible manner.

3. Summary of the Present Invention

It is an object of the present invention to provide a thermal imaging process whereby images are obtained with high optical densities, a low gradation and a good stability.

Further objects will become apparent from the description hereinafter.

According to the present invention, there is provided a thermal imaging process using (i) a donor element comprising on a support a donor layer containing a binder and a thermotransferable reducing agent capable of reducing a silver source to metallic silver upon heating and (ii) a receiving element comprising on a support a receiving layer comprising a silver source capable of being reduced by means of heat in the presence of a reducing agent, said thermal imaging process comprising the steps of bringing said donor layer of said donor element into face to face relationship with said receiving layer of said receiving element, image-wise heating a thus obtained assemblage by means of a thermal head, thereby causing image-wise transfer of an amount of said thermotransferable reducing agent to said receiving element in accordance with the amount of heat supplied by said thermal head and separating said donor element from said receiving element.

4. Detailed Descriptio of the Invention

The donor element for use according to present invention comprises on one side of the donor element a donor layer, comprising a reducing agent capable of reducing a silver source to metallic silver upon heating, and a binder.

The reducing agent for the silver source may comprise any of the conventional photographic developers known in the art, such as phenidones, hydroquinones and catechol provided that the reducing agent is thermotransferable.

Examples of suitable reducing agents are aminohydroxycycloalkenone compounds, esters of amino reductones, N-hydroxyurea derivatives, hydrazones of aldehydes and ketones, phosphoramidophenols, phosphoramidoanilines, polyhydroxybenzenes, e.g. hydroquinone, t-butylhydroquinone, isopropylhydroquinone, and (2,5-dihydroxyphenyl)methylsulfone, dihydroxybenzene derivatives such as pyrocatechol, and pyrogallol derivatives such as 4-phenylpyrocatechol, t-butylcatechol, pyrogallol, or pyrogallol derivatives such as pyrogallol ethers or esters, dihydroxybenzoic acid, dihydroxybenzoic acid esters such as dihydroxybenzoic acid, methyl ester, ethyl ester, propyl ester, butyl ester and the like, dihydroxy benzaldehyde and keton derivatives, gallic acid, gallic acid esters such as methy gallate, ethyl gallate, propyl gallate and the like, gallic acid amides, sulfhydroxamic acids, sulfonamidoanilines, 2-tetrazolylthiohydroquinones, e.g., 2-methyl-5-(1-phenyl-5-tetrazolylthio)hydroquinone, , tetrahydroquinoxalines, e.g. 1,2,3,4-tetrahydroquinoxaline, amidoximes, azines, hydroxamic acids, 5-pyrazolones, sulfonamidophenol reducing agents, 2-phenylindan-1,3-dione and the like, 1,4-dihydropyridines, such as 2,6-dimethoxy-3,5-dicarbethoxy-1,4-dihydropyridine, bisphenols, e.g., bis(2-hydroxy-3-t-butyl-5-methylphenyl) methane, bis(6-hydroxy-m-toly)mesitol, 2,2-bis(4-hydroxy-3-methylphenyl)propane, 4,4-ethylidene-bis(2-t-butyl-6-methylphenol) and 2,2-bis(3,5-dimethyl-4-hydroxyphenyl) propane, ascorbic acid derivatives and 3-pyrazolidones.

Reducing agents derived from dihydroxy or trihydroxyphenyl compounds are especially preferred. Highly preferred are 4-phenyl pyrocatechol and propyl gallate.

As a binder for the donor layer, hydrophilic or hydrophobic binders can be used, although the use of hydrophobic binders is preferred.

Hydrophilic binders which can be used are polyvinylalcohol, gelatine, polyacrylamide and hydrophilic cellulosic binders such as hydroxyethyl cellulose, hydroxypropyl cellulose and the like.

The hydrophobic binders may be used as a dispersion in e.g. water or as a solution in an organic solvent.

Suitable binders for the donor layer are cellulose derivatives, such as ethyl cellulose, methyl cellulose, cellulose nitrate, cellulose acetate formate, cellulose acetate hydrogen phthalate, cellulose acetate, cellulose acetate propionate, cellulose acetate butyrate, cellulose acetate pentanoate, cellulose acetate benzoate, cellulose triacetate; vinyl-type resins and derivatives, such as polyvinyl acetate, polyvinyl butyral, copolyvinyl butyral-vinyl acetal-vinyl alcohol, polyvinyl pyrrolidone, polyvinyl acetoacetal, polyacrylamide; polymers and copolymers derivated from acrylates and acrylate derivatives, such as polymethyl methacrylate and styreneacrylate copolymers; polyester resins; polycarbonates; copoly(styrene-co-acrylonitrile); polysulfones; polyphenylene oxide; organosilicones, such as polysiloxanes; epoxy resins and natural resins, such as gum arabic. Preferably, the binder for the donor layer of the present invention comprises poly(styrene-co-acrylonitrile) or a mixture of poly(styrene-co-acrylonitrile) and a toluenesulphonamide condensation product.

The binder for the donor layer preferably comprises a copolymer comprising styrene units and acrylonitrile units, preferentially at least 60% by weight of styrene units and at least 25% by weight of acrylonitrile units binder. The binder copolymer may comprise other comonomers than styrene units and acrylonitrile units. Suitable other comonomers are e.g. butadiene, butyl acrylate, and methyl methacrylate. The binder copolymer preferably has a glass transition temperature of at least 50° C.

It is also possible to use a mixture of the copolymer comprising styrene units and at least 15% by weight of acrylonitrile units with another binder known in the art, but preferably the acrylonitrile copolymer is present in an amount of at least 50% by weight of the total amount of binder.

The donor layer generally has a thickness of about 0.2 to 5.0 μm, preferably 0.4 to 2.0 μm, and the amount ratio of reducing agent to binder generally ranges from 9:1 to 1:3 by weight, preferably from 3:1 to 1:2 by weight.

The donor layer may also contain other additives such as i.a. thermal solvents, stabilizers, curing agents, preservatives, dispersing agents, antistatic agents, defoaming agents, and viscosity-controlling agents.

Any material can be used as the support for the donor element provided it is dimensionally stable and capable of withstanding the temperatures involved, up to 400° C. over a period of up to 20 msec, and is yet thin enough to transmit heat applied on one side through to the reducing agent on the other side to effect transfer to the receiver sheet within such short periods, typically from 1 to 10 msec. Such materials include polyesters such as polyethylene terephthalate, polyamides, polyacrylates, polycarbonates, cellulose esters, fluorinated polymers, polyethers, polyacetals, polyolefins, polyimides, glassine paper and condenser paper. Preference is given to a support comprising polyethylene terephthalate. In general, suitable supports can have a thickness of 2 to 30 μm, preferably a thickness of 4 to 10 μm is used. The support may also be coated with an adhesive or subbing layer, if desired.

Subbing layers comprising aromatic copolyesters, vinylidene chloride copolymers, organic titanate, zirconares and silanes, polyester urethanes and the like can be used.

The donor layer of the donor element can be coated on the support or printed thereon by a printing technique such as a gravure process.

A barrier layer for the reducing agent comprising a hydrophilic polymer may also be employed between the support and the donor layer of the donor element to enhance the transfer of reducing agent by preventing wrong-way transfer of reducing agent backwards to the support. The barrier layer for the reducing agent may contain any hydrophilic material that is useful for the intended purpose. In general, good results can be obtained with gelatin, polyacrylamide, polyisopropyl acrylamide, butyl methacrylate-grafted gelatin, ethyl methacrylate-grafted gelatin, ethyl acrylate-grafted gelatin, cellulose monoacetate, methylcellulose, polyvinyl alcohol, polyethyleneimine, polyacrylic acid, a mixture of polyvinyl alcohol and polyvinyl acetate, a mixture of polyvinyl alcohol and polyacrylic acid, or a mixture of cellulose monoacetate and polyacrylic acid.

Certain hydrophilic polymers e.g. those described in EP 227,091 also have an adequate adhesion to the support and the donor layer, so that the need for a separate adhesive or subbing layer is avoided. The particular hydrophilic polymers used in a single layer in the donor element thus perform a dual function, hence are referred to as barrier/subbing layers.

Owing to the fact that the thin support softens when heated during the printing operation and then sticks to the thermal printing head, thereby causing malfunction of the printing apparatus and reduction in image quality, the back of the support (the side opposite to that carrying the donor layer) is typically provided with a heat-resistant layer to facilitate passage of the donor element past the thermal printing head. An adhesive layer may be provided between the support and the heat-resistant layer.

Any heat-resistant layer known in the field of thermal sublimation printing or wax printing can be used in the present invention.

The heat-resistant layer generally comprises a lubricant and a binder. In the conventional heat-resistant layers the binder is either a cured binder as described in e.g. EP 153,880, EP 194,106, EP 314,348, EP 329,117, JP 60/151,096, JP 60/229,787, JP 60/229,792, JP 60/229,795, JP 62/48,589, JP 62/212,192, JP 62/259,889, JP 01/5884, JP 01/56,587, and JP 92/128,899 or a polymeric thermoplast as described in e.g. EP 267,469, JP 58/187,396, JP 63/191,678, JP 63/191,679, JP 01/234,292, and JP 02/70,485.

During printing, a smooth transport of the donor ribbon and the receiving element is required in order to obtain a good density uniformity all over the print.

It is preferred to use different types of lubricants to allow continuous transport of the donor ribbon relative to the thermal head.

Well known lubricants are polysiloxanes such as those mentioned in EP 267,469, U.S. Pat. Nos. 4,738,950, 4,866,028, 4,753,920 and U.S. Pat. No. 4,782,041. Especially useful slipping agents are polysiloxanepolyether block or graft polymers.

Other lubricants for the heat-resistant slipping layer of the donor element are phosphoric acid derivatives such as those mentioned in EP 153,880 and EP 194,106, metal salts of long fatty acids (such as mentioned in EP 458,538, EP 458,522, EP 314,348, JP 01/241,491 and JP 01/222,993), wax compounds such as polyolefin waxes such as e.g. polyethylene or polypropylene wax, carnauba wax, candelilla wax, bees wax, glycerine monostearate, amid wax such as ethylene bisstearamide and the like.

A heat-resistant layer such as mentioned in European Patent Application no. 93 202 050.6 is especially preferred.

Inorganic particles such as salts derived from silica such as e.g. talc, clay, china clay, mica, chlorite, silica, or carbonates such as calcium carbonate, magnesium carbonate or calcium magnesium carbonate (dolomite) can be further added to the heat-resistant layer.

It is highly preferred to add mixtures of particles to the heat resistant layer having a Mohs hardness below 2.7 and particles having a Mohs hardness above 2.7 such as mentioned in EP-A-93201642.1.

A mixture of talc and dolomite particles is highly preferred.

A particular heat-resistant layer for the present invention comprises as a binder a polycarbonate derived from a bis-(hydroxyphenyl)-cycloalkane, corresponding to general formula (I):

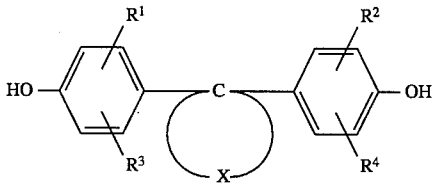

(I)

wherein:

$R^1$, $R^2$, $R^3$, and $R^4$ each independently represents hydrogen, halogen, a $C_1$–$C_8$ alkyl group, a substituted $C_1$–$C_8$ alkyl group, a $C_5$–$C_6$ cycloalkyl group, a substituted $C_5$–$C_6$ cycloalkyl group, a $C_6$–$C_{10}$ aryl group, a substituted $C_6$–$C_{10}$ aryl group, a $C_7$–$C_{12}$ aralkyl group, or a substituted $C_7$–$C_{12}$ aralkyl group; and X represents the atoms necessary to complete a 5- to 8-membered alicyclic ring, optionally substituted with a $C_1$–$C_6$ alkyl group, a 5- or 6-membered cycloalkyl group or a fused-on 5- or 6-membered cycloalkyl group, as lubricants polyether modified polysiloxane block copolymer and zinc stearate and as particles talc particles with a weight average particle size of 4.5 μm.

Lubricants and binder can be coated in a single layer, or can be casted in a separate layer. It is highly preferred to cast the salt of a fatty acid in the heat resistant layer (e.g. as a dispersion) and the polysiloxane based lubricant in a separate topcoat. This separate topcoat is preferably casted from a non-solvent for the heat-resistant layer.

The heat-resistant layer of the donor element may be coated on the support or printed thereon by a printing technique such as a gravure printing.

The heat-resistant layer thus formed has a thickness of about 0.1 to 3 μm, preferably 0.3 to 1.5 μm.

Preferably a subbing layer is provided between the support and the heat-resistant layer to promote the adhesion between the support and the heat-resistant layer. As subbing layer any of the subbing layers known in the art for dye-donor elements can be used. Suitable binders that can be used for the subbing layer can be chosen from the classes of-polyester resins, polyurethane resins, polyester urethane resins, modified dextrans, modified cellulose, and copolymers comprising recurring units such as i.a. vinyl chloride, vinylidene chloride, vinyl acetate, acrylonitrile, methacrylate, acrylate, butadiene, and styrene (e.g. poly(vinylidene chloride-co-acrylonitrile). Suitable subbing layers have been described in e.g. EP 138,483, EP 227,090, European Patent Application No. 92200907.1, U.S. Pat. Nos. 4,567,113, 4,572,860, 4,717,711, 4,559,273, 4,695,288, 4,727,057, 4,737,486, 4,965,239, 4,753,921, 4,895,830, 4,929,592, 4,748,150, 4,965,238, and U.S. Pat. No. 4,965,241.

The receiving element for use according to the printing method of the present invention comprises a receiving layer provided on a support, said receiving layer comprising a silver source capable of being reduced by means of heat in the presence of a reducing agent.

The reducible silver source may comprise any material which contains a reducible source of silver ions. Silver salts of organic and hetero-organic acids, particularly long chain fatty carboxylic acids (comprising from 10 to 30, preferably 15 to 25 carbon atoms) are preferred. Complexes of organic or inorganic silver salts in which the ligand has a gross stability constant for silver ion of between 4.0 and 10.0 are also useful. Examples of suitable silver salts are disclosed in Research Disclosure Nos. 17029 and 29963 and include: salts of organic acids, e.g., gallic acid, oxalic acid, behenic acid, stearic acid, palmitic acid, lauric acid and the like; silver carboxyalkylthiourea salts, e.g., 1-(3-carboxypropyl)thiourea, 1-(3-carboxypropyl)-3,3-dimethylthiourea and the like; complexes of silver with the polymeric reaction product of an aldehyde with a hydroxy-substituted aromatic carboxylic acid, e.g., aldehydes, such as formaldehyde, acetaldehyde and butyraldehyde, and hydroxy-substituted acids, such as salicyclic acid, benzilic acid, 3,5-dihdyroxybenzilic acid and 5,5-thiodisalicylic acid: silver salts or complexes of thiones, e.g., 3-(2-carboxyethyl)-4-hydroxymethyl-4-thiazoline-2-thione and 3-carboxymethyl-4-methyl-4-thiazoline-2-thione; complexes of salts of silver with nitrogen acids selected from imidazole, pyrazole, urazole, 1,2,4-triazole and 1H-tetrazole, 3-amino-5-benzylthio-1,2,4-triazole and benzotriazole: silver salts of saccharin, 5-chlorosalicylatdoxime and the like: and silver salts of mercaptides.

The preferred silver source is silver behenate.

The silver source is preferably added as a dispersion to the coating liquid of the receiving layer.

As binding agent for the receiving layer preferably thermoplastic water insoluble resins are used wherein the ingredients can be dispersed homogeneously or form therewith a solid-state solution. For that purpose all kinds of natural, modified natural or synthetic resins may be used, e.g. cellulose derivatives such as ethylcellulose, cellulose esters, carboxymethylcellulose, starch ethers, polymers derived from α,β-ethylenically unsatured compounds such as polyvinyl chloride, after chlorinated polyvinyl chloride, copolymers of vinyl chloride and vinylidene chloride, copolymers of vinyl chloride and vinyl acetate, polyvinyl acetate and partially hydrolysed polyvinyl acetate, polyvinyl alcohol, polyvinyl acetals, e.g. polyvinyl butyral, copolymers of acrylonitrile and acrylamide, polyacrylic acid esters, polymethacrylic acid esters and polyethylene or mixtures thereof. A particularly suitable ecologically interesting (halogen-free) binder is polyvinyl butyral. A polyvinyl butyral containing some vinyl alcohol units is marketed under the trade name BUTVAR B79 of Monsanto USA.

The binder to organic silver salt weight ratio is preferably in the range of 0.2 to 6, and the thickness of the image forming layer is preferably in the range of 5 to 16 μm.

It is preferred to use a so-called toning agent in the receiving layer or in a layer adjacent to said receiving layer. This toning agent serves to change the tone of the silver image from brown to black or grey. Suitable toning agents are e.g. phthalazinone, phthalazine, phthalimide, succinimide, phthalic acid, benzimidazole or a compound according to formula (II):

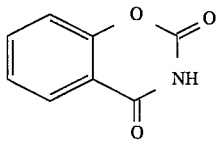

(II)

The use of phthalazinone or compound (II) is highly preferred.

It is highly preferred to use a release agent in the receiving element on the side of the receiving layer. This release agent may be added to the coating solution of the receiving layer or may be applied, optionally in a mixture with other ingredients, as a separate layer called the release layer on top of said receiving layer. The use of a release layer is preferred, since the release agent is in that case on top of the receiving element.

The use of a release agent is preferred in the printing method of the present invention since the reducing agents useful in the present invention can give rise to a sticky contact between donor element and receiving element.

As release agents, inorganic and organic release agents can be used. Among them, the organic release agents are preferred.

Solid waxes, fluorine- or phosphate-containing surfactants and silicone oils can be used as releasing agent. Suitable releasing agents have been described in e.g. EP 133012, JP 85/19138, and EP 227092.

When, as mentioned above, a separate release layer, incorporating the release agent, is coated on top of said receiving layer, other ingredients such as binders, plasticizers, or particulate fillers such as talc, silica or collodial particles can be added to said release layer, provided that the transfer of the reducing agent to the receiving layer comprising the reducible silver source can take place.

Examples of binders for the release layer are polyvinylbutyral, ethylcellulose, cellulose acetate propionate, cellulose acetate butyrate, polyvinylchloride, copolymers of vinylchloride, vinylacetate and vinylalcohol, aromatic or aliphatic copolyesters, polymethylmethacrylate, polycarbonates derived from bisphenol A, polycarbonates comprising bisphenols according to formula (I) and the like. The release layer can also act as a protective layer for the images.

A subbing layer is usually provided between the support and the receiving layer, such as those mentioned in e.g. U.S. Pat. No. 4,748,150, 4,954,241, 4,965,239 and 4,965,238 and European Patent Application No. 92 201 620.9.

The subbing layer can further comprise other polymers, particles, or low molecular weight additives. Addition of inorganic particles such as silica, colloidal silica, water soluble polymers such as gelatin, polymeric latices, polystyrene sulfonic acid and polystyrene sulfonic acid sodium salt, surfactants such as cationic, anionic, amphoteric and non-ionic surfactants, and polymeric dispersants is preferred.

Especially preferred additives are colloidal silica, the above mentioned surfactants, butadiene containing latices such as poly(butadiene-co-methylmethacrylate-co-itaconic acid), polystyrene sulfonic acid and polystyrene sulfonic acid sodium salt. The addition of silica to the subbing layer decreases sticking on the coating roll after coating of the subbing layer. The addition of polystyrene sulfonic acid or polystyrene sulfonic acid sodium salt to the subbing layer accelerates the recycling process.

The subbing layer of the present invention is applied directly to the support of the receiving element. The subbing layer can be applied by coextrusion or can be coated on the support. Coating from an aqueous solution is preferred due to its simplicity and the possibility of adding other ingredients.

The receiving layer is usually hydrophobic in order to enhance the absorption of reducing agent into the receiving element. The polyester recycling procedure, however, uses a cleaning step whereby the film waste is immersed in an alkaline or acid soap solution in water. It is an object of this cleaning process to remove all layers casted on the polymeric substrate.

In order to remove the hydrophobic receiving layer, it is highly preferred to cast an intermediate layer of an hydrophilic polymer between the subbing layer and the receiving layer. This intermediate layer accelerates the cleaning step in the recycling procedure. Typical examples of hydrophilic polymers which can be used in such intermediate layers are polyvinyl alcohol, polyacrylamide, hydroxyethylcellulose, gelatin, polystyrene sulfonic acid, polyethylene glycol, poly(meth)acrylic acid, poly(meth)acrylic acid, alkali metal salts of polyacrylic acid, crosslinked copolymers containing (meth)acrylic acid or alkali metal salts of (meth)acrylic acid, alkali metal salts of polystyrene sulfonic acid, dextran, carrageenin and the like. Alkali metal salts of polystyrene sulfonic acid such as the sodium salt of polystyrene sulfonic acid is highly preferred, since the use of this polymer in the intermediate layer results in better anti-static properties of the receiving element. Anti-static coatings such as those described in EP 440,957 can be incorporated in the intermediate layer or in the subbing layer. This results both in a higher hydrophilicity and in better anti-static properties.

The intermediate layer may further comprise polymeric dispersions or latices, surfactants, inorganic particles such as silica and colloidal silica and the like. Addition of surfactants, colloidal silica and/or latices is preferred. Addition of silica to the intermediate layer decreases sticking to the coating roll after coating. Addition of latices to the intermediate layer improves the addition and improves the removing step in the recycling process in case of acrylic acid or methacrylic acid type latices.

The intermediate layer may also have a cushioning property, such as mentioned in U.S. Pat. No. 4,730,397.

The support for the receiver sheet may be a transparent film of e.g. polyethylene terephthalate, a polyether sulfone, a polyimide, a cellulose ester, or a polyvinyl alcohol-co-acetal. The support may also be a reflective one such as baryta-coated paper, polyethylene-coated paper, or white polyester i.e. white-pigmented polyester. Blue-coloured polyethylene terephthalate film can also be used as a support.

Although the subbing layer is useful for application on polyethylene-coated paper, substrates based on polyester, transparent or reflective, are preferred. In this case, the subbing layer can be applied before, during or after the biaxial stretching procedure.

At the opposite side of the receiving element (opposite to the receiving layer), a backcoat can be provided, optionally in combination, with an appropriate subbing layer to improve the adhesion between the backcoat and the support.

Hydrophilic as well as hydrophobic backcoats can be used. Hydrophilic backcoats can be applied easily from water, while hydrophobic backcoats have the advantage that the backcoat performs well at all humidity levels (no curl).

Examples of hydrophilic backcoat layers are layers comprising polyvinylalcohol, polyethylene glycol, polyacrylamide, hydroxyethylcellulose, dextran and gelatin. The use of gelatin is highly preferred.

These hydrophilic backcoat layers may further comprise dispersions, or latices of hydrophobic polymers, inorganic particles, surfactant and the like. The addition of these particles can be used in order to obtain a specific surface gloss, such as mentioned in European patent application No. 91 203 008.7. Especially preferred particles are silica and polymethylmethacrylate beads of 0.5 to 10 μm. Antistatic treatment can also be provided to said backcoat layer.

Examples of hydrophobic backcoat layers are backcoat layers comprising addition polymers such as polymethylmethacrylate, polyvinylchloride and polycondensates such as polyesters, polycarbonates in combination with the above mentioned particles for the hydrophilic backcoat layers.

With hydrophobic backcoat layers, it can be useful to provide an intermediate hydrophilic layer between the subbing layer and the backcoat layer, such as those mentioned for use at the receiving side of the receiving element, in order to improve the removal of the backcoat layer in the recycling procedure.

The printing method of the present invention uses a thermal head to selectively heat specific portions of the donor element in contact with a receiving element. The thermal head can be a thick or thin film thermal head although the use of a thin film thermal head is preferred, since this offers more opportunities to obtain appropriate gradation. The pressure applied to the thermal head is preferably between 120 and 400 g/cm heater line. A spatial resolution of 150 dpi or higher is preferred. The average printing power is calculated as the total amount of energy applied during one line time divided by the line time and by the surface area of the heat-generating elements.

Although a higher average printing power results in higher optical densities of the final image, it is preferred to use an average printing power below 10 W/mm$^2$. At higher printing energies, deformation of the receiving layer and/or receiving sheet occurs.

The time needed for printing one single line with the thermal head, also called the line time, is preferably below 45 ms. Longer line times result in longer printing times and more deformation of the receiving sheet and/or receiving layer.

In order to increase the density of the final image after printing line-by-line with a thermal head, an overall heat treatment of the receiving element may be performed. This heat treatment can be e.g. done with an infrared source, a heated air stream or a hot plate but is preferably done by means of a heated roller.

It is believed that during the overall heat treatment, the transferred reducing agent can further react with the reducible silver source.

By selecting the appropriate diameter and speed of the heated roller, the heat treatment time for the overall heating can be adjusted. Moreover, the heated rollers can be used to uncurl the receiving sheet after printing.

The following examples illustrate the invention in more detail without, however, limiting the scope thereof.

EXAMPLES

Preparation of the Receiving Element

A subbed polyethylene terephthalate support having a thickness of 100 μm was coated in order to obtain the following receiving layer:

silver behenate 4.5 g/m$^2$ compound II mentioned above 0.34 g/m$^2$ polyvinylbutyral (Butvar B79, Monsanto) 4.5 g/m$^2$ After drying, a release layer was coated from hexane comprising 0.03 g/m$^2$ Tegoglide 410 (polyether-polysiloxane blockcopolymer from Goldschmidt). This receiving element was used in the following printing examples.

Preparation of the Donor Elements

Both sides of a 5.7 μm thick polyethylene terephthalate support were coated with a subbing layer of a copolyester comprising ethylene glycol, adipic acid, neopentyl glycol, terephthalatic acid, isophthalic acid, and glycerol.

The resulting subbing layer was covered with a solution in methyl ethyl ketone of 13% of a polycarbonate having the following structural formula (III):

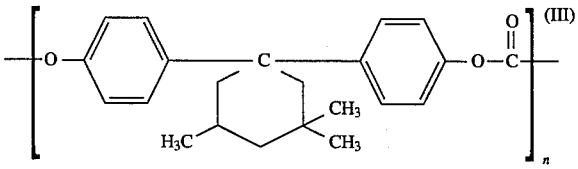

(III)

wherein n represents the number of units to obtain a polycarbonate having a relative viscosity of 1.30 as measured in a 0.5% solution in dichloromethane, 0.5% of talc (Nippon Talc P3, Interorgana) and 0.5% of zinc stearate.

Finally, a top layer of polyether-modified polydimethylsiloxane (Tegoglide 410, Goldschmidt) was coated from a solution in isopropanol on the resulting heat-resistant polycarbonate layer.

The other side of the donor element was provided with a donor layer. The nature of the ingredients is mentioned in table I. The binder and reducing agent were casted at a concentration of 10 weight % in butanone. These coating solutions were applied at a wet thickness of 10 μm by means of a wire bar. The resulting layer was dried by evaporation of the solvent.

Printing of the Combination of Donor and Receiving Elements

Printing was performed by contacting the donor layer side of the donor element with the receiving layer of the receiving element, followed by heating by means of a thermal head. The thermal head was a thin film thermal head heated (pulse wise activation) at an average printing power of 5 Watt/mm$^2$ and a line time of 18 ms, a duty cycle of 75% and with a resolution of 300 dpi. The pressure applied between the thermal head and the rotating drum carrying the receiving and donor element was 160 g/cm heater line. After printing, the receiving element was separated from the donor element.

The printed image was a 16-step grey scale between data level 0 and 255 (8 bit). The data levels of the different steps were choosen equidistant with respect to the input data level in order to obtain the native sensitometry. The comparitive monosheet was printed in direct contact with the thermal head, without the use of a donor element.

Overall Heat Treatment

All receiving elements were reheated on a hot plate of 118° C. for 10 seconds.

Measurement of the Optical Density of the Prints

The optical maximal densities of the prints were measured behind a visual filter in a Macbeth TR924 densitometer in the grey scale part corresponding to data level 255.

Determination of the Number of Visible Grey Tones

The number of visible grey tones of the printed image after heat treatment was determined by counting the number of fields of the grey scale which have a visual different grey density than the other fields (including the density corresponding to data level 0). A high number indicates a soft or low gradation. The results are listed in table 1.

TABLE I

| Exam. | Binder type | Reducing agent | Optical density after printing | Optical density after heat treatment | Visible grey tones |
|---|---|---|---|---|---|
| 1 | I | 1 | 0.80 | 1.30 | 10 |
| 2 | II | 1 | 0.90 | 1.53 | 10 |
| 3 | III | 1 | 0.80 | 1.32 | — |
| 4 | IV | 1 | 0.89 | 1.45 | 10 |
| 5 | I | 1 (15 wt %) | — | 1.66 | — |
| 6 | I | 2 | — | 2.24 | 10 |
| 7 | II | 3 | 0.13 | 0.39 | 12 |
| 8 | I | 4 | 1.00 | 1.59 | 9 |
| 9 | I | 5 | 0.68 | 1.31 | 12 |
| 10 | I | 6 | 1.72 | 1.99 | 10 |
| 11 | IV | 7 | 0.44 | 1.05 | 11 |
| 12 | I | 8 | 1.66 | 2.29 | 12 |
| 13 | I | 9 | 1.23 | 2.10 | 11 |
| 14 | I | 10 | 0.92 | 1.53 | 11 |
| 15 | I | 11 | 1.45 | 1.73 | 11 |
| 16 | I | 12 | — | 2.24 | — |
| 17 | I | 13 | — | 2.47 | — |
| 18 | I | 14 | — | 1.80 | — |
| 19 | I | 15 | — | 1.78 | — |

TABLE I-continued

| Exam. | Binder type | Reducing agent | Optical density after printing | Optical density after heat treatment | Visible grey tones |
|---|---|---|---|---|---|
| 20 | I | 16 | — | 1.79 | — |
| 21 | Comparative Monosheet | | 260 | — | 5 |

The comparative monosheet (21) was prepared by coating a subbed polyethylene terephthalate support having a thickness of 170 μm so as to obtain thereon after drying the following recording layer including:

silver behenate 4.47 g/m$^2$ polyvinyl butyral 2.24 g/m$^2$ reducing agent S as defined hereinafter 0.85 g/m$^2$ 3,4-dihydro-2,4-dioxo-1,3,2H-benzoxazine 0.32 g/m$^2$ silicone oil 0.02 g/m$^2$ Reducing agent S is a polyhydroxy spiro-bis-indane, viz. 3,3,3',3'-tetramethyl-5,6,5',6'-tetrahydroxy-spiro-bis-indane.

After drying said recording layer was coated at 22° C. at a wet coating thickness of 100 μm with the following coating composition for forming a protective layer.

methyl ethyl ketone 94 g polycarbonate according to formula (III) 6 g

Tegoglide 410 (Goldschmidt) 0.6g

The thus coated layer was dried in an air current whereby a protective scratch-resistant layer was obtained. This monosheet can thus be used without a donor element.

Reducing Agents 1 3,4,5-tri-hydroxy-n-propylbenzoate 2 3,4-dihydroxy-ethylbenzoate 3 p-phenylsulfonamido-phenol 4 3,4,5-trihydroxy-ethylbenzoate 5 3,4,5-trihydroxy-n.octylbenzoate

6

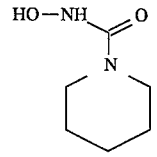

7

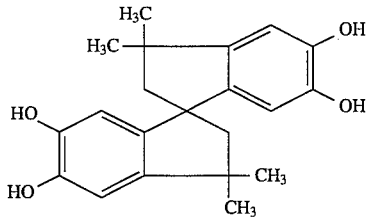

8 4-methoxy-naphtol 9 1,2dihydroxy-4-phenyl-benzene 10 3,4,5-trihydroxy-methylbenzoate 11 3,4dihydroxybenzoic acid 12 3,4dihydroxybenzaldehyde 13 n.propyl-3,4-dihydroxyphenyl-ketone 14 phenyl-(3,4-dihydroxyphenyl)-ketone 15 3,4-dihydroxy-n.butylbenzoate 16 3,4-dihydroxy-n.hexylbenzoate Binders I Luran 388S (polystyrene-co-acrylonitrile, BASF)

II Cellulose acetate propionate (PLFS 130, Celanese)

III Nitrocellulose type E510 (Wolf Walsrode)

IV Cellulose acetate butyrate (CAB 171 15, Eastman Kodak).

It is clear from table I that high optical densities can be achieved by the above printing method. It is also clearly demonstrated that the heat treatment after printing further increases the optical density. Moreover, when continuous tone grey scales were printed with the donor elements in combination with the receiving element of the present example in a printer using a thermal head, a smooth grey scale having a low gradation is obtained. The number of visible grey tones is higher than in the prior art system (monosheet).

We claim:

1. A thermal imaging process comprising in order, the steps of:

a) bringing a donor layer of a donor element into face to face relationship with a receiving layer of a receiving element to obtain an assemblage, b) image-wise heating the assemblage by means of a thermal head, thereby causing image-wise transfer of an amount of a thermotransferable reducing agent to said receiving element in accordance with the amount of heat supplied by said thermal head, c) separately said donor element from said receiving element, and d) overall heating said receiving element, wherein (i) said donor element comprises said donor layer on a support, wherein said donor layer comprises both a binder and a thermotransferable reducing agent which is capable of reducing a silver source to metallic silver upon heating, and (ii) said receiving element comprises said receiving layer on a support, said receiving layer comprising a silver source which is capable of being reduced by means of a heat in the presence of a reducing agent.

2. A thermal imaging process according to claim 1, wherein said thermally reducible source of silver is an organic silver salt.

3. A thermal imaging process according to claim 2, wherein said organic silver salt is silver behenate.

4. A thermal imaging process according to claim 1, wherein said receiving layer of said receiving element containing said silver source further comprises a toning agent.

5. A thermal imaging process according to claim 1, wherein said receiving element further comprises a release agent in said receiving layer or in a separate layer on top thereof.

6. A thermal imaging process according to claim 5, wherein said release agent is a silicone compound.

7. A thermal imaging process according to claim 1 wherein the average printing power applied by means of the thermal head during said image-wise heating is not more than 10 Watt/mm$^2$.

8. A thermal imaging process according to claim 1, wherein said image-wise heating is carried out line by line and wherein the time for printing a single line with said thermal head is at most 45 ms.

9. A thermal imaging process according to claim 1, wherein said overall heating is performed by means of a heated roller.

* * * * *

UNITED STATES PATENT AND TRADEMARK OFFICE

CERTIFICATE OF CORRECTION

PATENT NO. : 5,589,317

DATED : December 31, 1996

INVENTOR(S) : Defieuw et al.

It is certified that error appears in the above-indentified patent and that said Letters Patent is hereby corrected as shown below:

Title page, 1st Column, lines 10-11, "Pat. No. 5,547,809" should read --Pat. Nos. 5,601,962; 5,587,270; 5,587,269; 5,587,268; 5,595,854; 5,547,809 and the patent issuing from 5,627,008--.

Column 2, line 60, "Descriptio" should read --Description--;

Column 4, line 36, "zirconares" should read --zirconates--;

Column 7, line 4, "5-chlorosalicylatdoxime" should read --5-chlorosalicylaldoxime--;

Column 9, line 9, "4,730,397" should read --4,734,397--;

Column 13, line 15, "comprising in" should read --comprising, in--.

Signed and Sealed this

Seventeenth Day of June, 1997

Bruce Lehman

*Attest:*

BRUCE LEHMAN

*Attesting Officer*

*Commissioner of Patents and Trademarks*